US005531336A

United States Patent [19]

Parham et al.

[11] Patent Number: 5,531,336

[45] Date of Patent: Jul. 2, 1996

[54] DEVICE FOR STABILIZING CONTAINERS IN A GRAVITY FEED TRAY

[75] Inventors: Dennis E. Parham, Kennesaw; Mark J. Sampson, Atlanta, both of Ga.

[73] Assignee: The Mead Corporation, Smyrna, Ga.

[21] Appl. No.: 212,022

[22] Filed: Mar. 11, 1994

[51] Int. Cl.[6] ..... A47F 5/00

[52] U.S. Cl. ..... 211/183; 211/59.2; 211/184; 211/74

[58] Field of Search ..... 211/59.2, 59.3, 211/74, 184; 312/42, 45, 72

[56] References Cited

U.S. PATENT DOCUMENTS

| | | | |
|---|---|---|---|
| 4,460,096 | 7/1984 | Ricci | 211/184 |
| 4,478,337 | 10/1984 | Flum | 211/49 |
| 4,593,823 | 6/1986 | Fershko et al. | 211/49.1 |
| 4,598,828 | 7/1986 | Young et al. | 211/59.2 |
| 4,685,574 | 8/1987 | Young et al. | 211/59.2 |
| 4,724,968 | 2/1988 | Wombacher | 211/59.3 |
| 4,785,943 | 11/1988 | Deffner et al. | 211/59.2 |
| 4,785,945 | 11/1988 | Rowse et al. | 211/59.2 |
| 4,801,025 | 1/1989 | Flum et al. | 211/128 |
| 4,923,070 | 5/1990 | Jackle et al. | 211/59.2 |
| 4,958,739 | 9/1990 | Spamer | 211/153 |
| 5,024,336 | 6/1991 | Spamer | 211/59.2 |
| 5,050,748 | 9/1991 | Taub | 211/59.2 |
| 5,111,942 | 5/1992 | Bernardin | 211/59.3 |
| 5,351,838 | 10/1994 | Flum | 211/59.2 |
| 5,379,905 | 1/1995 | Bustos et al. | 211/59.2 |

*Primary Examiner*—Robert W. Gibson, Jr.
*Attorney, Agent, or Firm*—Needle & Rosenberg

[57] ABSTRACT

Abutment stops for adapting a gravity-fed shelving unit of a type commonly used in refrigerated displays to accommodate bottles having a contoured profile and a higher center of gravity than common cylindrical cans is disclosed. One such abutment stop includes a vertical wall having a slot for resting the device on a side wall of a channel of the shelving unit. The device is stabilized by a bifurcated mounting column extending back from the slot. The top of the abutment stop provides a support or rest for a portion of a frontmost bottle at a point higher than that at which the bottle would be supported by the shelving unit alone. A pair of such abutment stops, one on each side wall of the channel, may be provided at or near the front of the channel to support bottles within the channel. Optional variations include supports that extend into only channel, or into both adjacent channels, break away tabs at the bottom of the abutment stop to provide a height adjustment, and a top which may extend either in back of or in front of the vertical wall of the abutment stop. The abutment stop may also cooperate with a sliding stair-step-like support that rests on the same channel wall to provide another method of height adjustment. An alternate version of the device having a contoured front and back face, the front face contoured to fit against the front of the channel, and the back face contoured to support a bottle, is also described. This one-piece contoured version may be fit in the front of a single channel, and has a height greater than the front wall of the channel to provide support to a higher portion of a bottle than is possible with the front wall alone. Non-adjustable versions of the abutment stop may also be formed as an integral part of a shelf unit.

17 Claims, 7 Drawing Sheets

DEVICE FOR STABILIZING CONTAINERS IN A GRAVITY FEED TRAY

This invention relates to a gravity feed tray for guiding and supporting a plurality of parallel rows of containers and, more particularly, to a device for adapting shelving units, which are primarily but not exclusively for use in refrigerated displays, to accommodate bottles having a contoured profile and higher center of gravity than cylindrical cans.

BACKGROUND OF THE INVENTION

U.S. Pat. No. 4,314,648, issued Feb. 9, 1982, assigned to the assignee of this invention, and hereby incorporated by reference into this specification, discloses a gravity feed shelf for use in a display device which is not refrigerated and which is formed of a plurality of similarly constructed channel-like chutes assembled together on a display shelf.

U.S. Pat. No. 4,593,823, also assigned to the assignee of this invention, and likewise incorporated by reference into this specification, discloses a specially constructed gravity feed-type shelf unit arranged for disposition in spaced relation above another similarly constructed shelf unit, each unit comprising a gravity feed type main chute structure having side edges to which a supplementary chute structure is detachably mounted so as to render the device adaptable to accommodate various space requirements such as are to be found in refrigerated display cabinets commonly used in supermarkets, the shelf units being formed preferably by an injection molding procedure.

The above-identified inventions have been particularly suitable for gravity feeding of uniformly-shaped containers, such as 12-ounce soft drink cans. However, some soft drink bottlers have begun producing a contoured bottle containing 20 ounces of beverage. These contoured bottles do not have a uniform vertical cross-section, are taller than the soft drink cans they replace on the shelves, and have a higher center of gravity than the cylindrical cans. When one or more bottles are standing up in a feeding channel formed by two longitudinally extending, opposed, parallel side walls, the gravity feeding arrangement causes the bottle nearest the front wall to contact the usually U-shaped front wall of the channel. As a result of the bottle's contours and its height, this contact occurs only at the base of the front channel wall and since the front bottle is unsupported above the base and has a high center of gravity relative to the height of the front wall, the front bottles tend to tip or rotate over the front wall and fall out of the channels. Moreover, the floors of the channels are typically designed to reduce friction between the channel floors and the bottoms of the containers, which tends to increase the likelihood of tipping.

The prior art gravity-feed units continue to work well for cylindrical cans and other types of containers. Additionally, there are numerous such units in use at this time and it would be prohibitively expensive to purchase new shelving units which can accommodate the large contoured bottles without the bottles tipping out of their channels. Therefore, it would be desirable and economical to retain the existing units in use. However, because of the anticipated popularity of the new contoured bottles (which are often made of plastic in a form reminiscent of historic glass bottle designs), it would be desirable to store and display such bottles in these gravity-feed units without interfering with the user's ability to withdraw other types of containers, including the cylindrical cans, from the shelving units.

BRIEF SUMMARY OF THE INVENTION

The present invention comprises a device for retrofitting the prior art gravity-feed shelving units so that they can accommodate the newer contoured bottles while avoiding the inconvenience of the bottles tipping over or jamming the channels. The purpose of the present invention is to contact the forwardmost bottle in a channel higher up on the bottle and further back on the radius of the main diameter thereof to prevent the bottle from rotating out of the tray. The container is thus supported at a select distance away from the front wall of the tray or shelf unit.

The device, in one embodiment, is an abutment stop which is mounted atop each of the side walls of the unit adjacent the front wall of the unit and includes a means for engaging the forwardmost container in a channel at a position which is higher on the external surface of the container than would be possible by means of the container engaging the front wall of the shelving unit. In this manner, the forwardmost container in a channel is prevented from unintentionally tipping over the front wall of the unit.

The invention comprises a unitary device having a front wall having at least a vertical portion having a slot therethrough adapted to engage the top of a channel wall, the slot opening at and extending vertically from the bottom of the front wall; at least one container engaging means extending from the front wall and positioned above the slot to contact a portion of the exterior surface of a gravity-fed container in the channel; and stabilization means extending from the back of the front wall to prevent rotational movement of the front wall about a first axis parallel to the slot and to prevent rotational movement of the front wall about a second axis perpendicular to the slot and the surface of a channel wall engaged by the slot. Reinforcement means may be provided between the container support means and the stabilization means to provide additional rigidity to abutment stop. Additional stabilization may be provided by adhesive means.

Other embodiments provide a means for adjusting the height of the abutment stop above the floor of the shelving unit. In these embodiments, adhesive means, frictional means, or means depending from the bottom of the abutment stabilize the abutment stop against rotational movement. The adjustable height is provided by elevating the top end of the slot in the abutment stop so that the top of the slot can rest above the wall of the channel.

In still other embodiments, abutment stops are provided that are suitable for controlling the gravity feeding of a single chute or channel without interfering with the feeding of adjacent channels. One such embodiment comprises a modified upper extension that provides an engaging surface extending into only one channel and into the path of travel of the forwardmost container in a channel, either to the left or the right of the channel wall upon which the abutment stop is mounted. Another such embodiment comprises a single-piece design that is held in the front of the channel by friction and that has a front side conforming to the inside front channel wall and a rear side having engaging surfaces that extend above the top of the front channel wall.

It is thus an object of the invention to provide an economical device for upgrading existing gravity-feed displays to accommodate different types of bottles, including contoured bottles having a high center of gravity, that cannot presently be readily accommodated without frequent tipping.

It is a further object of the invention to provide such an upgrade in a manner that retains the use of some or all of the display for the conventional containers for which the display was originally designed.

These and other objects of the invention will become apparent to one skilled in the art upon a thorough reading of the detailed description that follows.

BRIEF DESCRIPTION OF THE FIGURES OF THE DRAWINGS

FIG. 6 is an exploded perspective view of the third embodiment of an abutment stop in accordance with the invention that permits containers to rest closer to the front wall of a shelf unit in which the abutment stops are employed than other embodiments, while FIG. 6A is a perspective view of the same embodiment;

DETAILED DESCRIPTION OF THE ILLUSTRATIVE EMBODIMENTS OF THE INVENTION

Figure 1:
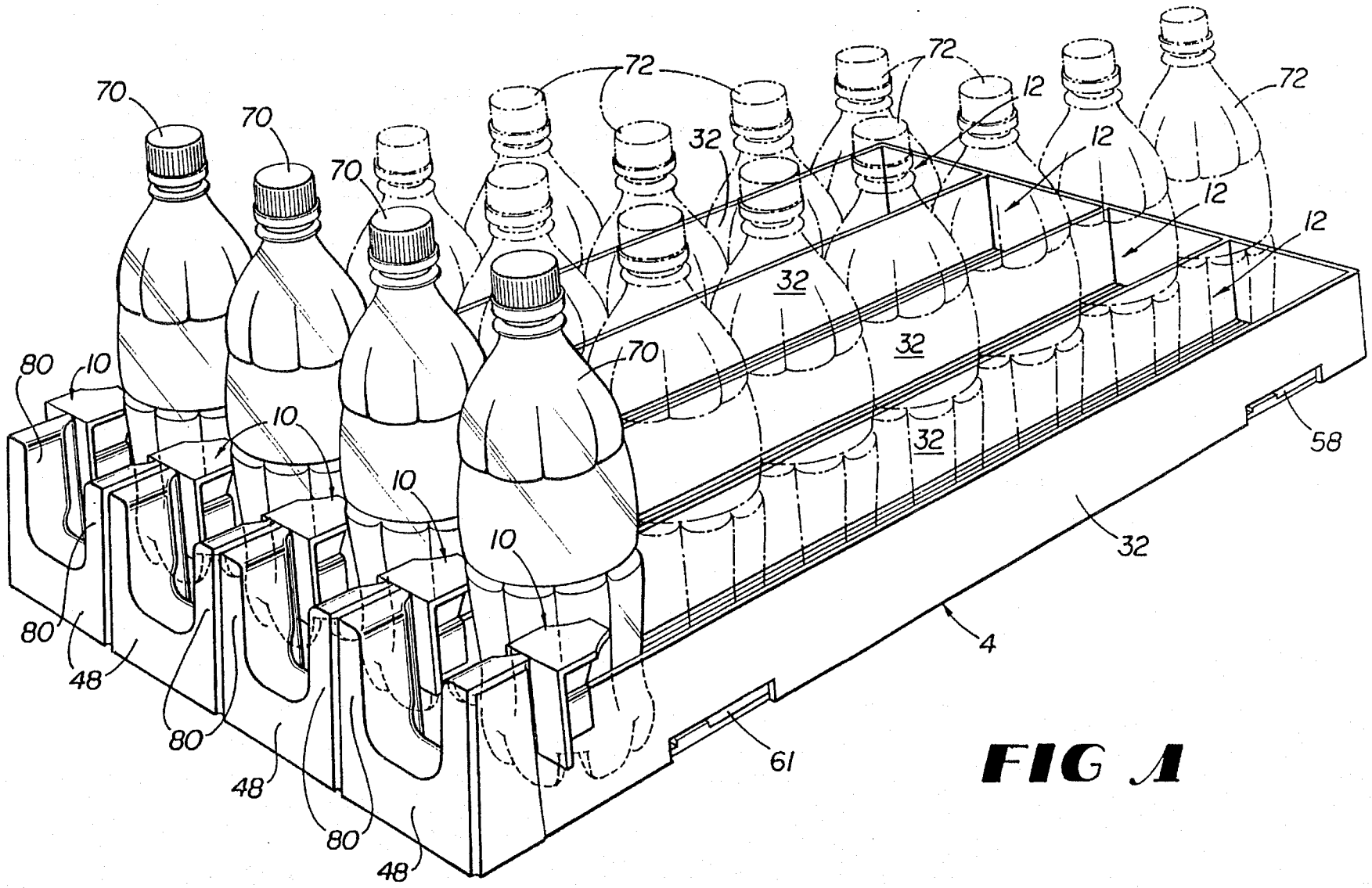
FIG. 1 is a perspective view of a typical gravity-feed type shelf unit in which a first embodiment of the inventive abutment stop is shown in a typical use.

Referring now to FIG. 1, a typical gravity-feed type shelf unit 4 is shown in which an embodiment of the invention 10 is shown in a typical use. Shelf unit 4 comprises a number of channels 12, into each of which a plurality of containers, such as contoured bottles 70, 72 may be placed. Shelf unit 4 may be joined to other similar shelf units with the aid of guide passages 58, 61 in a conventional manner. Shelf unit 4 also comprises a plurality of (possibly hollow) U-shaped front channel walls 48, each forming the front of a different one of channels 12, and having an arcuate back surface (not shown) facing the channel 12 behind it to accommodate containers inside the channel 12. In use, shelf unit 4 is usually tilted upwardly slightly so that upright bottles 70, 72 slide along the floor of the unit towards the front walls 48 of their respective channels. The forwardmost bottle 70 at the front end of a channel 12 may be removed by a customer, causing any bottles 72 behind bottle 70 in the same channel 12 to slide forward into the void left behind by the removal of bottle 70. Each channel 12 is formed by a pair of parallel, longitudinally extending channel side walls 32.

To accommodate contoured bottles 70 or other bottles having a high center of gravity in front of channels 12 while avoiding horizontal tipping of such bottles within their respective channels 12, an abutment stop 10 in accordance with one embodiment of the invention is placed on each one of the pair of channels walls 32 of the channel 12 containing such bottles. Abutment stop 10 is secured by any suitable means (including, but not limited to, glue, tape, other adhesive means, gravity or friction) at or near the end of its respective channel wall 32, proximate the corresponding front wall 48, and is preferably secured thereto.

Figure 2:
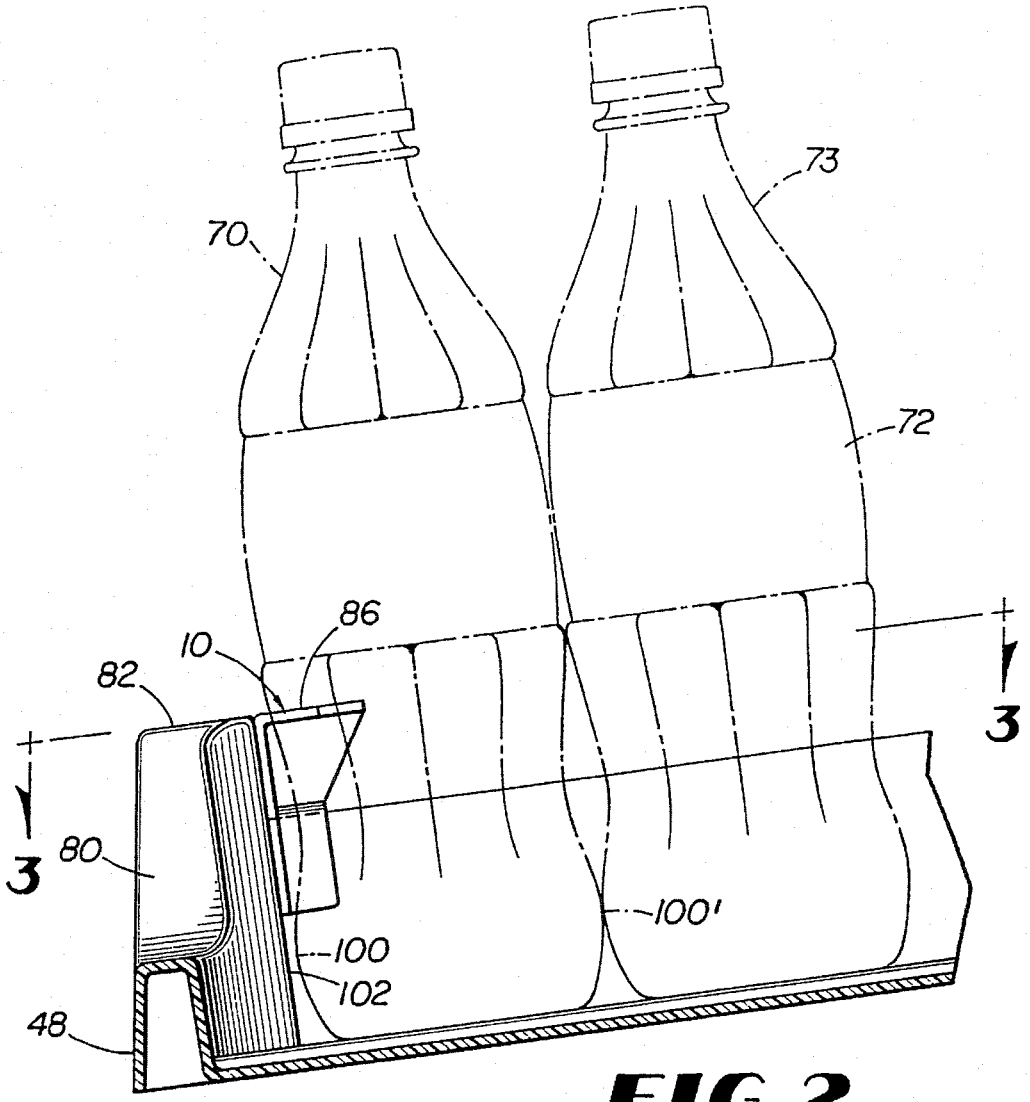
FIG. 2 is a fragmentary vertical cross-sectional view of the front end of the shelf unit of FIG. 1 which illustrates the purpose and operation of the first embodiment of the abutment stop in greater detail.

Referring now to FIG. 2, the purpose and operation of abutment stop 10 is readily apparent. FIG. 2 illustrates a portion of a length-wise cross-section of a channel 12. To better understand FIG. 2, it should be understood that the hollow inside the lower portion of front wall 48 (which is not a part of the invention) is shown. Bottle 70 is supported against gravity by an upper extension 86 of abutment stop 10 at a relatively high point on the major diameter of bottle 70, just below the label. Thus, when bottle 70 is removed, bottle 72 can slide forward (along with any additional bottles behind bottle 72) and contact upper extension 86 without the tendency to tip over.

Without abutment stop 10, bottle 70 would be supported only at a low level 100, well below the center of gravity of bottle 70, because the cross-section of bottle 70 is such that no contact would be made with the arms 82 of U-shaped wall 48. Upon removal of bottle 70, bottle 72 would slide forward, striking the rear surface of U-shaped wall 48 at a point or points 102 very close to the bottom of channel 12. Supporting bottle 72 at a point or points 100' near the bottom would be insufficient to stop the motion of the upper part of bottle 72 against the bottle's own inertia. The force of wall 48 on the bottom of bottle 72 being applied in a direction opposite to that of the momentum of the sliding bottle 72 and at a point well below the center of gravity of bottle 72 can cause bottle 72 to tip over, with its stem portion 73 eventually protruding out of the front of U-shaped wall 48. Clearly, tipping may also occur if bottles 70, 72 are loaded from the rear of channel 12, as well. Because bottles 70, 72 are vertically elongated, tipped bottles occupy excess space within channels 12, and additionally reduce the attractiveness of the display. Under some circumstances, they may even fall out of the front of the display.

Figure 3:
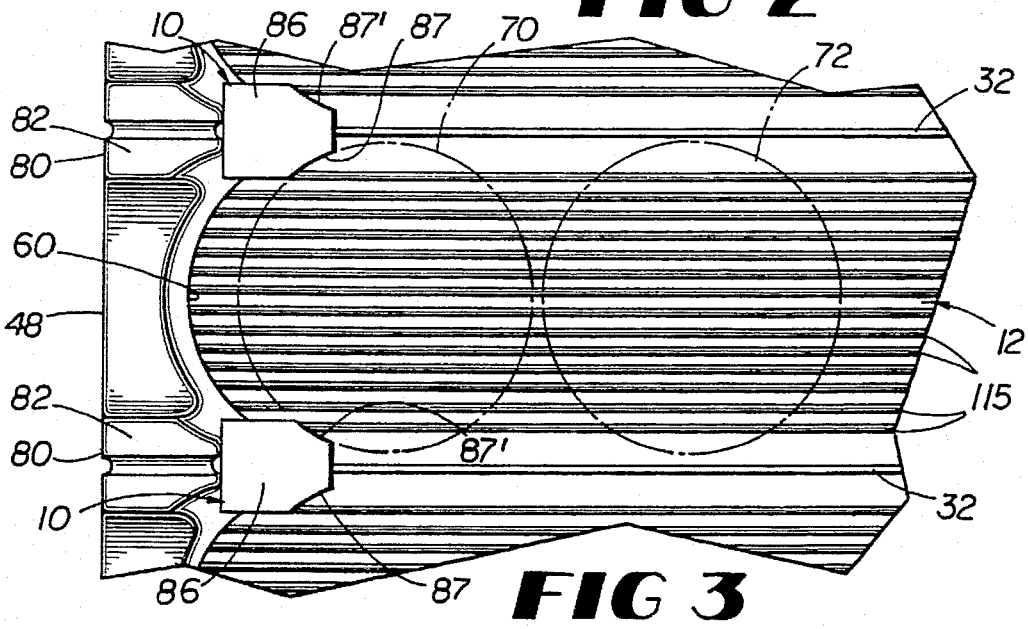
FIG. 3 is a top plan view taken along line 3—3 in FIG. 2 showing the relationship of the abutment stop illustrated in FIG. 2 with the containers in the channel.

FIG. 3 shows a top view of channel 12 taken along section lines 3 in FIG. 2. To aid in understanding FIG. 3, ribs 115 in channel 12 are identified. Ribs 115 are commonly present in channels 12 to reduce friction so that bottles 70, 72 will slide more readily along the floor of channel 12.

The upper extension 86 includes a means for engaging the forwardmost bottles 70 in channels 12. It will be observed that the back portion of upper extension 86 has arcuate cut-outs 87 and 87' interconnecting the opposed sides 88 and the forward end 89 that are adapted to engage and support the curved cross-section of bottles 70 and 72 at the level of upper extension 86. Only one of cut-outs 87,87' extend into and overlie channel 12 so as to contact bottle 70, as illustrated; the other cut-out is adapted to contact a bottle, if any, in an adjacent channel. The cut-outs 87, 87' are arranged symmetrically on upper extension 86, so that abutment stops 10 are interchangeable with one another. Bottle 70 is supported behind the curved back of wall 48, which bottle 70 need not contact due to the added support of abutment stops 10. The height of cut-outs 87, 87' against which the bottles rest is sufficiently near the center of gravity of the bottle to prevent tip-over of bottles sliding down the floor of channel 12.

Figure 4:
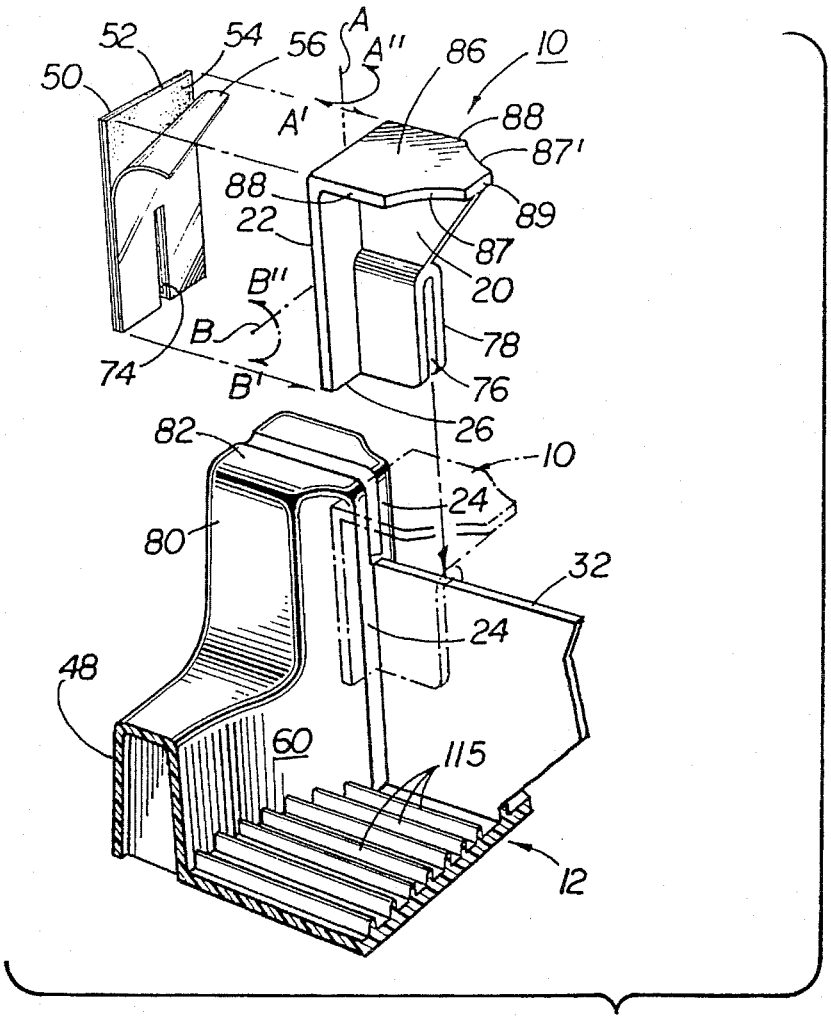
FIG. 4 is an exploded partial fragmentary perspective view showing how the first embodiment of the abutment stop is attached to a wall of a channel.

The embodiment of the inventive abutment stop 10 shown in FIGS. 1–3 may seen in greater detail in FIG. 4. Abutment stop 10 comprises a body portion in the form of vertical front wall 22 having a slot 76 (the rear of which extends through bifurcated mounting column 78) adapted to engage a channel wall, such as wall 32, the slot 76 opening at and extending vertically from the bottom 26 of front wall 22 and a container engaging means comprising an upper extension 86 which projects rearward from, and is perpendicular to, the front wall 22. The extension 86 faces the rear wall of shelf unit 34, and is positioned above slot 76 to contact and support a gravity-fed container inside channel 12.

Also, stabilization means depend from the back of front wall 22 and comprise a bifurcated mounting column 78 enveloping slot 76 to prevent dislocation caused by rotational movement of front wall 22 about a first axis A parallel to the slot 76 in either direction A' or A". By mounting the abutment stop 10 on wall 32 so that the top 77 of slot 76 in bifurcated column 78 rests on the top of channel wall 32, dislocation caused by rotational movement of front wall 22 about a second axis B perpendicular to slot 76 and channel wall 32 in at least one direction B' is thereby prevented.

Abutment stop 10 may be secured to a rear wall 24 of a prong of U-shaped wall 48 (and the immediately adjacent prong of the U-shaped wall at the front of the adjacent channel, if any) by any suitable means, such as double sided adhesive, to prevent dislocation caused by rotation in the other direction B" about axis B. To add additional rigidity to abutment stop 10, reinforcement means such as gusset 20 may be provided between the container engaging means and the stabilization means.

As seen in FIG. 4, the attachment of abutment stop 10 to U-shaped wall 48 may be made with double-sided pressure-sensitive foam adhesive tape 52 or any other suitable material having adhesive sides 50 and 54, or by other attachment means. To provide the greatest adhesion, tape 52 is preferably supplied in a shape matching the front wall 22 of abutment stop 10. Peel-off strips 56 may be provided on both adhesive sides of tape 52, and may be left in place until the abutment stop 10 is ready for installation. Slot 74 in adhesive tape 52 is placed over channel wall 32, and adhesive side 50 is pressed into place over surfaces 24 on the back of U-shaped wall 48. Abutment stop 10 is placed on channel wall 32, after which it is slid towards pressure-sensitive adhesive face 54 and pressed into place. Thus, a stable, firmly-positioned support for a container is provided by abutment stop 10.

Figure 5:
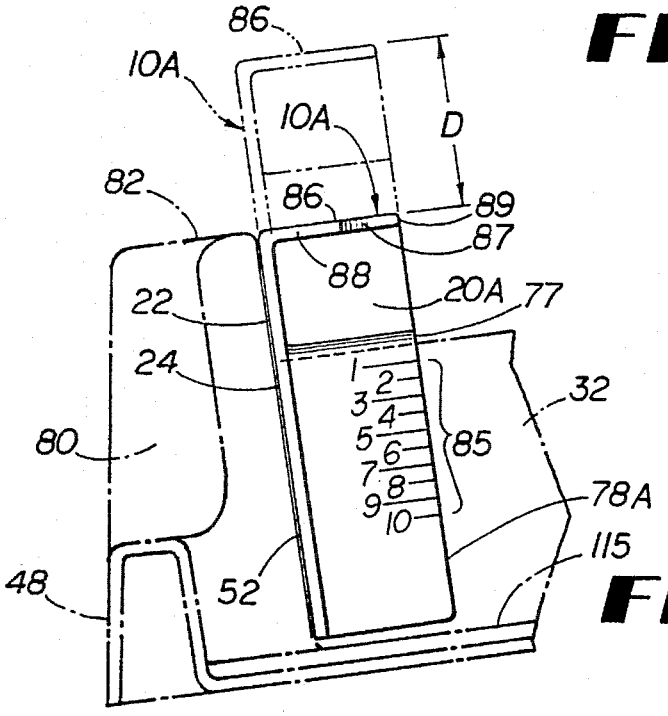
FIG. 5 is a fragmentary cross-sectional view of the second embodiment of an abutment stop in accordance with the invention that can be adjusted to accommodate various types of bottles with the shelf unit shown in phantom lines.

If the stabilization against rotation around the B axis provided by adhesives is sufficient, then an adjustable added height D at which the upper extension 86 of an abutment stop contacts a gravity fed bottle may be provided, as shown in FIG. 5. The second embodiment 10A of the invention shown in FIG. 5 is similar to that shown in FIG. 4, except that the bifurcated mounting column 78A is extended to essentially the entire vertical height of wall 32 to maximize the adjustment range. Also, gusset 20A has been selected to illustrate another one of the various suitable gusset shapes. Abutment stop 10A may be positioned above the top edge of wall 32 by a predetermined amount to provide an additional height D prior to pressing stop 10A against the adhesive tape 52. Calibration marks 85 may be provided on a side of the bifurcated mounting column 78 to allow accurate placement. Alternately, front wall 22 may simply be made longer, and upper extension 86 may be placed along front wall 22 above the top 82 of prong 80 of U-shaped wall 48 if a fixed additional height is sufficient.

Figure 6:
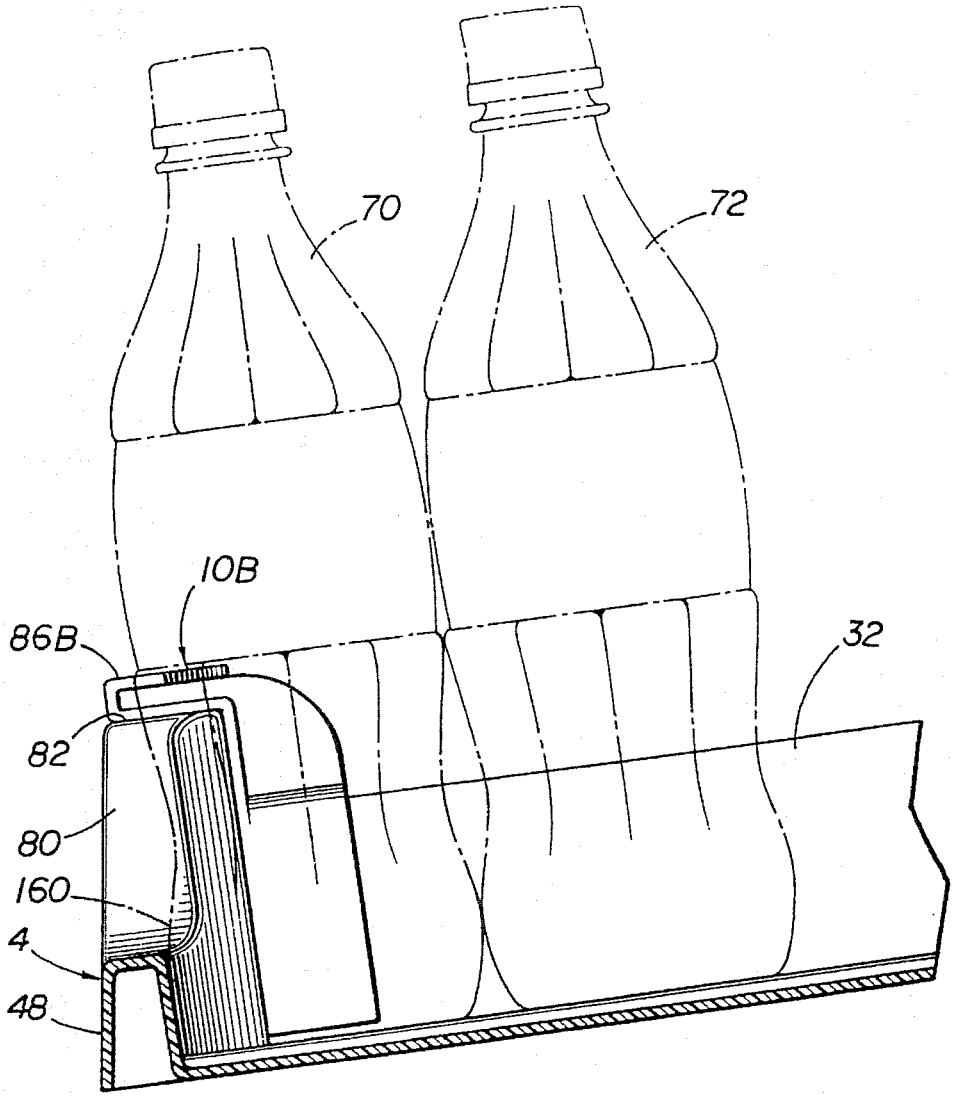
FIGS. 6 and 6A are views of a third embodiment of the invention.
Figure 6A:
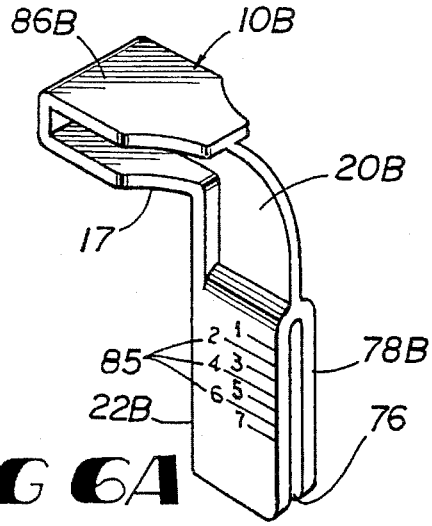

A third embodiment 10B of the invention is shown in FIGS. 6 and 6A. In this embodiment, the container support means 86B depends from the front rather than the rear of the front wall 22B, which can be merely the front of the bifurcated column 78B in this or the other embodiments illustrated. The bottom face 17 of container support means 10B can thus be disposed directly on the top 82 of prong 80 or, by using suitable adhesives, elevated above the top 82 of prong 80. With this embodiment, a bottle 70 can come to rest in position 160, closer to the front of shelf unit 4 than where it would rest using first embodiment 10.

Figure 7:
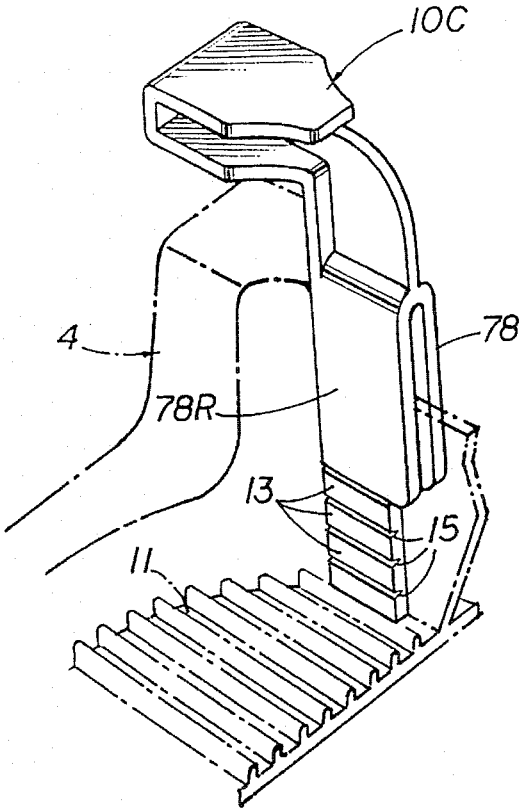
FIG. 7 is a perspective view of the fourth embodiment of an abutment stop in accordance with the invention in which break-away tabs provide an adjustment to accommodate various types of bottles.

A fourth embodiment of an abutment stop 10B in accordance with the invention is shown in FIG. 7. In this embodiment, a series of fransible tabs 13 depend vertically underneath at least one of the halves 78R of bifurcated column 78. The tabs 13 are separated by V-shaped weakened fracture lines 15 to allow a selected number of tabs 13 to be broken off, thus forming a depth gauge foot to rest upon channel floor 11 to fix the height of the abutment stop attachment 10C.

Figure 8:
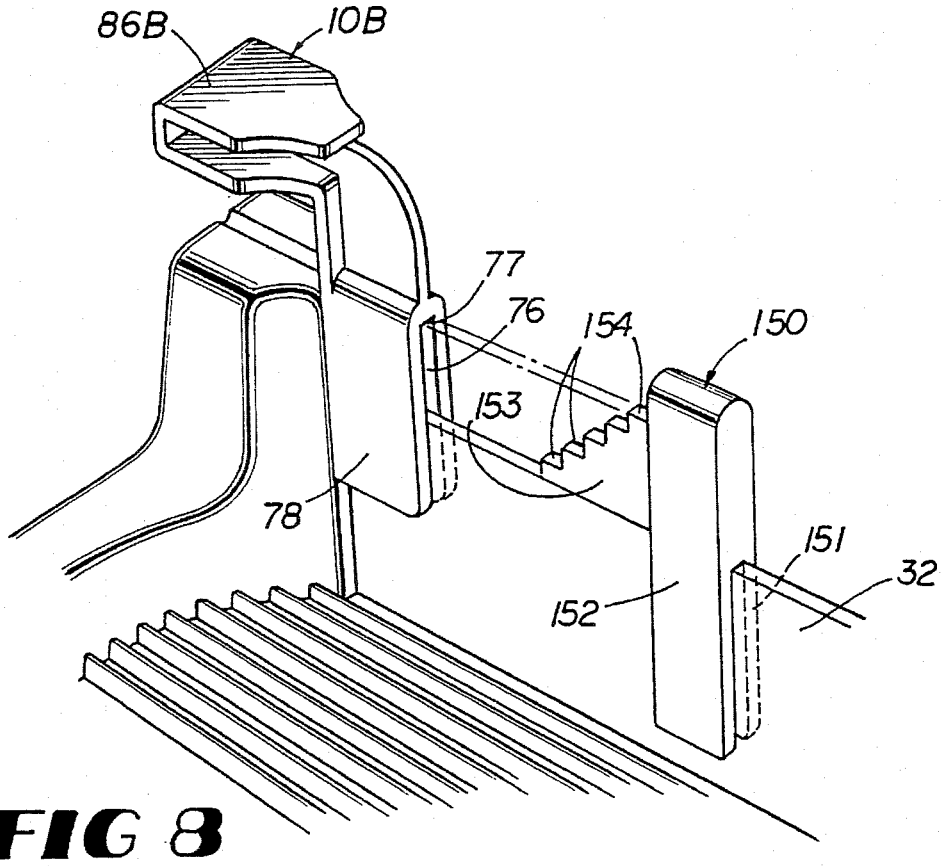
FIG. 8 is a fragmentary perspective view of the fifth embodiment of the present invention showing a sliding step adjustment means that alternately may be provided.

Alternately, an auxiliary sliding step adjustment means 150 as shown in the fifth embodiment of FIG. 8 may be provided to accomplish elevation of the inventive abutment stop. As seen in FIG. 8, the sliding step adjustment means 150 comprises a partially bifurcated clip 152 having a slot 151 for mounting on wall 32. Extending from the front face of step adjustment means 150 towards the stop 10B is a flange 153 having steps 154 along its forward face. The width of flange 153 is selected to match the width of slot 76, so that the top 77 of slot 76 can rest on a selected step 154, thereby elevating bottle support means 86B by a selected height.

Figure 9:
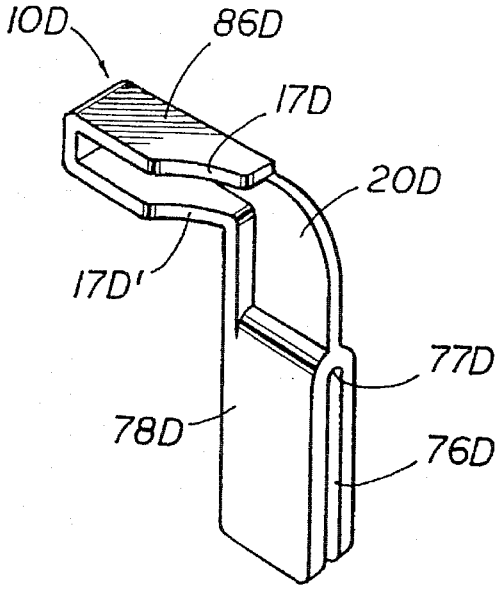
FIG. 9 is a perspective view of the sixth embodiment of the present invention illustrating a modification of the upper extensions of abutment stops in accordance with the invention, the modification being suitable for situations in which it is not desired to provide an abutment stop for adjacent channels, or on a channel at the end of a shelf.

Each of the abutment stops discussed thus far comprise upper extensions having two cut-outs 87, 87' against which a containers in adjacent channels may rest. Sometimes it is desirable not to have the upper extension interfere with the gravity feed of containers in an adjacent channel. In other cases, it may be desirable to provide an abutment stop for a channel at an end of the gravity-fed shelf without having an upper extension overhang an edge of the shelf. Thus, the upper extensions 86 and 86B in the previously discussed embodiments may be modified as shown in FIG. 9, which shows an abutment stop 10D having an upper extension 86D that extends over the top end 82 of only one-half of the prongs 80 of adjacent U-shaped walls 48. It is envisioned that abutment stop 10D may be manufactured in either a left-handed or a right-handed version (i.e., as illustrated in FIG. 9 and a mirror image thereof), to be used on either the left or right side wall of a channel, as appropriate. Each such stop 10D would have cut-outs 17D, 17D' on only one side, and have upper extension 86D dimensioned to extend over only one-half of a top 82 of a U-shaped wall 48, so that the operation of the adjacent channel on the side of the extension 86D opposite cut-outs 17D and 17D' is not affected by stop 10D.

By way of illustration, the embodiment of FIG.9 also shows a gusset 20D and bifurcated mounting column 78D having slot 76D, the latter having a top portion 77D. Note that upper extension 86D may be a single element, or, for better support, either a thick solid element or an approximation thereof, such as the two sections shown in FIG. 9, each having cut-outs 17D and 17D', respectively.

Figure 10:
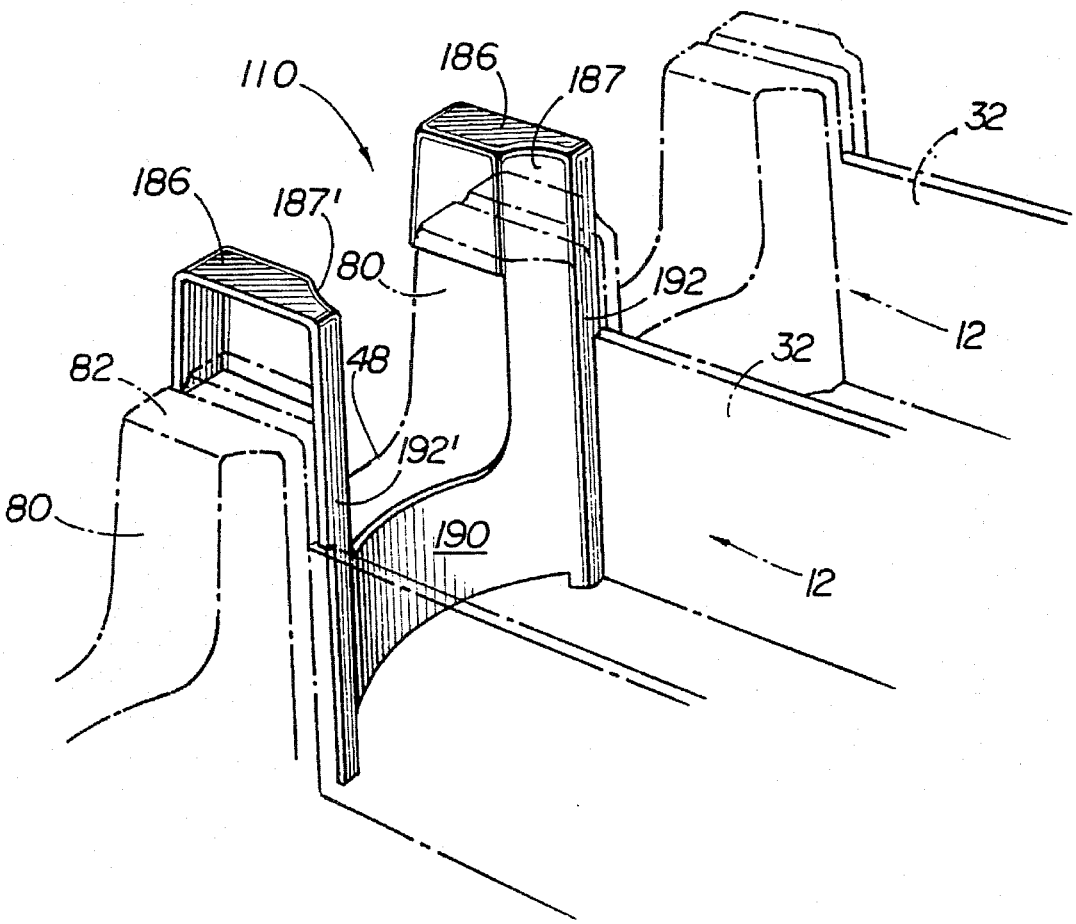
FIG. 10 is a fragmentary perspective view of the seventh embodiment of an abutment stop in accordance with the invention, in which the abutment stop comprises a one-piece construction that spans a channel.

A seventh embodiment is shown in FIG. 10. In this embodiment, a single-channel, one-piece abutment stop 110 is provided which spans across a channel 12 between side walls 32. Abutment stop 110 is essentially U-shaped, having a convex arcuate front face (not shown) conforming with the inside face of wall 48 (i.e., the face of wall 48 upon which containers rest when gravity-fed through channel 12 without any abutment stop being present) and an arcuate rear face 190, the curvature being essentially cylindrical with an axis essentially parallel to the prongs 192, 192' of the "u". The prongs 192, 192' also comprise an arcuate inner surface 187, 187' which is an extension of arcuate rear face 190, and that extend a predetermined height above the tops 82 of U-shaped wall 48 of channel 12. Surfaces 187, 187' can thus provide support for gravity-fed bottles in channel 12 at a greater height than is possible with wall 48 alone, thereby reducing the possibility of tipping. The abutment stop 110 may be suitably dimensioned to be held in place between walls 32 of channel 12 by friction. As shown in FIG. 10, the one-piece abutment stop can fit entirely within one channel without interfering with other adjacent channels.

Figure 11:
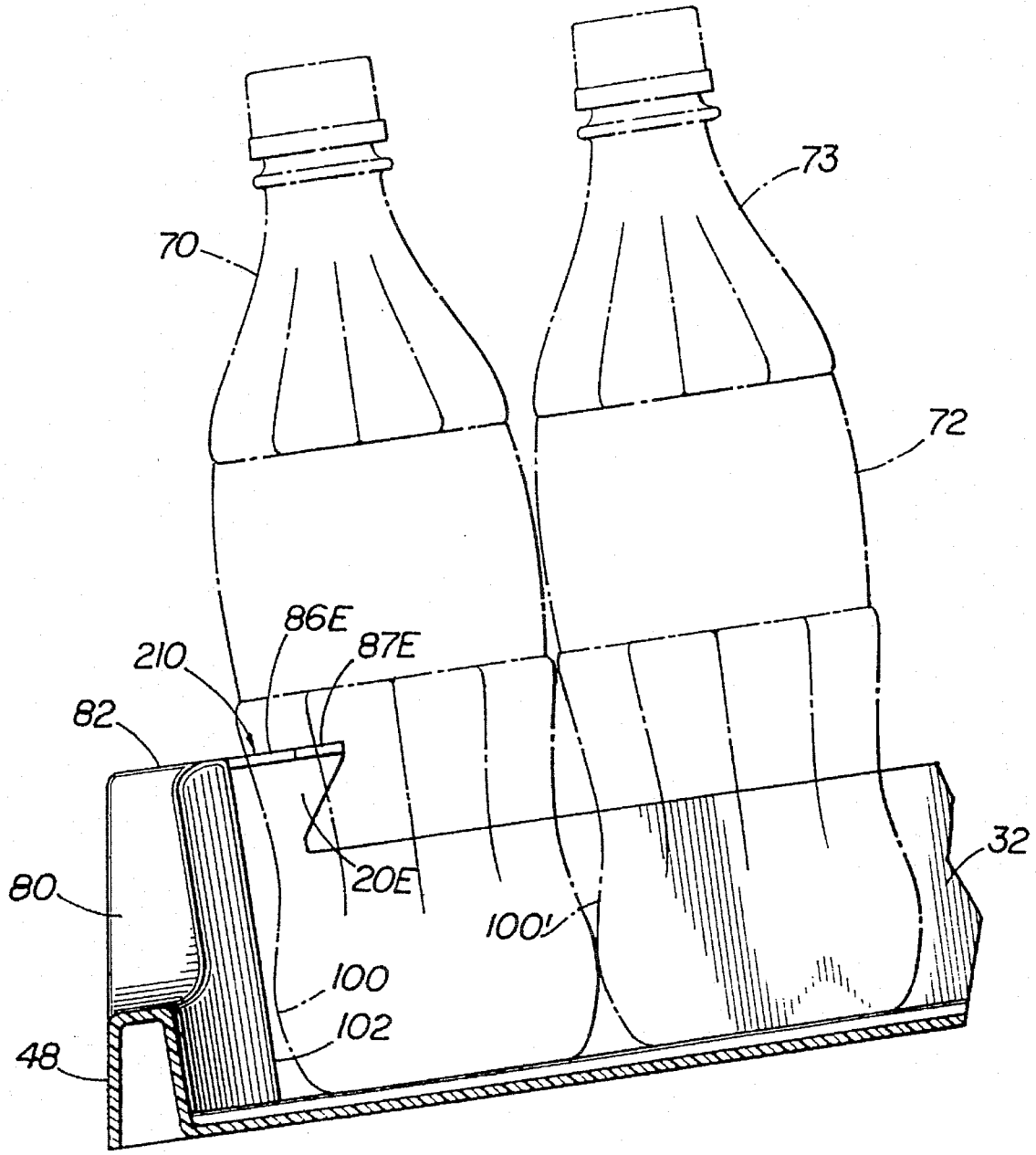
FIG. 11 is a fragmentary vertical cross-sectional view of the front end of a shelf unit illustrating an abutment stop integral to a gravity-fed shelf unit.

Each of the embodiments of the inventive abutment stop described thus far have been physically separate devices for attachment to an existing shelf or tray unit. It will be recognized, however, that a abutment stop having a non-adjustable height may be formed or molded along with such a unit as an integral part of the unit itself. Thus, for example, as shown in FIG. 11, abutment stop 210 in accordance with the invention comprises an extension 86E integral to and extending rearward from a prong 80, with extension 86E having an arcuate cut-out 87E for contacting the frontmost bottle 70 in a channel. A pair of such abutment stops 210 would be required, one on each side of the channel. Extension 86E may extend and overlie a adjacent channels and have an arcuate cut-out for each of the adjacent channels, as does extension 86 of abutment stop 10 of FIG. 2, thus enabling it to serve as one of the abutment stops required for each of the adjacent channels, or it may overlie only one channel, as does extension 86D of abutment stop 10D in FIG. 9, depending upon the sizes and shapes of the bottles to be accommodated in the channels and whether the abutment stop is at the extreme left or right side of the shelf unit. Returning to FIG. 11, an optional integral gusset 20E may be provided for reinforcement. Gusset 20E may be integral with either prong 80 or channel wall 32, or preferably both.

It will thus be seen that an inventive abutment stop is provided that, in the several embodiments described above, prevents tipping of bottles of certain sizes and shapes in gravity fed channels of a type commonly used in display shelves. While several embodiments of the invention have been shown and described, it should be recognized that numerous modifications obvious to those skilled in the art may be made without departing from the spirit of the invention, which is delimited solely by the accompanying claims.

What is claimed is:

1. An improvement for a gravity-feed type shelf unit for containers of the type having a channel for receiving containers in a row and for supporting and guiding the containers therein for movement along a path of travel, the channel having a front end and a rear end, the front end being defined by a front wall, the improvement comprising:

an abutment stop comprising:

(a) a body portion comprising an upright section having a front face and a rear face, a lower end and an opposed upper end, the upper end of the body portion terminating in a projection which is perpendicular to the body portion the projection having a pair of opposed sides and a forward end;

(b) means on the projection of the body portion for engaging the forwardmost container in the channel so as to prevent the forwardmost container from contacting the front wall comprising an acute-shaped cut-out in the projection interconnecting at least one side with the forward end; and (c) means for mounting the body portion onto the unit adjacent the front wall so as to dispose the engaging means towards the rear end of the channel and into the path of travel.

2. The improvement of claim 1 wherein the mounting means comprises the body portion defining a slot longitudinally formed therein through the lower end, the slot being dimensioned to receive therein a top surface of a side wall of a channel.

3. The improvement of claim 1 and wherein the mounting means further comprises adhesive means to secure the stop on a side wall of a channel.

4. An abutment stop for retrofitting a gravity-feed type shelf unit for containers, the shelf unit comprising one or more channels, each channel having at least a pair of opposed, longitudinally disposed side walls, each of which may be shared with an adjacent channel, a front wall, an opposed rear wall an a floor extending between the front and rear walls, the abutment stop comprising:

(a) a vertical body portion adapted to engage one of the side walls of a channel, the body portion having a slot opening at and extending essentially vertically from the bottom of the vertical body portion and extending through the body portion, the slot being dimensioned to receive therein at least a portion of a side wall;

(b) a container engaging means positioned above the slot and in the path of travel in the channel of the forwardmost container to contact and support a portion of the container; and (c) stabilization means on the back of the vertical body portion to prevent, when the slot is engaged with the side wall, rotational movement of the vertical body portion about a first axis parallel to the slot and rotational movement of the vertical body portion about a second axis perpendicular to the slot and the surface of the engaged side wall.

5. The abutment stop of claim 4, wherein the abutment stop further comprises reinforcement means disposed between the container engaging means and the stabilization means to provide additional rigidity.

6. The abutment stop of claim 5, wherein the container support means comprises an upper extension extending horizontally from the rear of the vertical body portion, the upper extension having an arcuate cut-out adapted to engage a portion of the external surface of a container.

7. The abutment stop of claim 6, wherein the upper extension has a pair of opposed, arcuate cut-outs therethrough, each cut-out adapted to engage a portion of the external surface of a container so as to support the forwardmost containers in adjacent channels at a select distance away from the front wall of the shelf unit.

8. The abutment stop of claim 6, wherein the stabilization means comprises a bifurcated mounting column enveloping the slot.

9. The abutment stop of claim 8, wherein the reinforcement means comprises a gusset.

10. An adjustable-height abutment stop for retrofitting a gravity-feed type shelf unit for containers, the shelf unit comprising one or more channels, each channel having at least a pair of longitudinally disposed side walls, each of which may be shared with an adjacent channel, and a front channel wall;

the adjustable-height abutment stop comprising:

(a) a front vertical portion adapted to engage one of the side walls of the channel, the front vertical portion defining a slot opening at and extending essentially vertically from the bottom of the front vertical portion;

(b) a container engaging means horizontally extending behind the front vertical portion and positioned above the slot to contact and support a portion of the forwardmost container in a channel;

(c) stabilization means on the back of the front vertical portion to prevent, when the slot is engaged with one of the side walls, rotational movement of the front vertical portion about an axis perpendicular to the slot and the surface of the engaged side wall; and (d) calibration means disposed on a side of the stabilization means to provide a height indication of the container support means, whereby the container support means may be positioned at a selected height indicated by the calibration means by affixing the front vertical portion to the front channel wall.

11. The abutment stop of claim 10, wherein the abutment stop further comprises reinforcement means disposed between the container engaging means and the stabilization means to provide additional rigidity.

12. The abutment stop of claim 11, wherein the container engaging means comprises an upper extension extending horizontally from the rear of the front vertical portion, the upper extension having an arcuate cut-out therethrough which extends into the channel and which is to engage and support the forwardmost container in a channel.

13. The abutment stop of claim 12, wherein the container engaging means comprises an upper extension extending horizontally from the rear of the front vertical portion towards the rear wall of the shelf unit, the upper extension having opposed, parallel sides, a front and a pair of arcuate cut-outs interconnecting a side with the front, each cut-out adapted to support a container in adjacent channels.

14. The abutment stop of claim 12, wherein the stabilization means comprises a bifurcated mounting column enveloping the slot.

15. The abutment stop of claim 14, wherein the reinforcement means comprises a gusset.

16. The adjustable-height abutment stop of claim 14, wherein the calibration means comprises a tab depending from a bottom of one portion of the bifurcated mounting column, the tab having a series of parallel groves at selected distances from the bottom of the one portion of the bifurcated mounting column to permit a portion of the tab to be broken off so that a portion of the tab that remains attached to the bifurcated mounting column may elevate the abutment stop by engaging the floor of the channel.

17. An improvement for a gravity-fed type shelf unit for containers of the type having a channel for receiving containers in a row and for supporting and guiding the containers therein for movement along a path of travel, the channel having a left side, a right side, a front end and a rear end, the front end being defined by a front wall, and the left and the right sides being defined by a left wall and a right wall, respectively, the improvement comprising at least a first and a second abutment stop, the first abutment stop unitary with a portion of the front wall above the left wall, and the second abutment stop unitary with a portion of the front wall above the right wall, each of the abutment stops comprising:

(a) a body portion essentially perpendicular to and extending rearward from the front wall; and (b) an arcuate-shaped cut-out defined by the body portion capable of engaging a forwardmost container in the channel so as to prevent the forwardmost container from contacting the front wall, the cut-out disposed towards the rear end of the channel defined by the left and the right walls and into the path of travel.

* * * * *